US007619902B2

(12) United States Patent
Buchbender et al.

(10) Patent No.: US 7,619,902 B2
(45) Date of Patent: Nov. 17, 2009

(54) CONNECTION MODULE FOR A POWER SWITCH

(75) Inventors: Guido Buchbender, Meckenheim (DE); Kurt Tanda, Leverkusen (DE); Gerd Voiss, Cologne (DE)

(73) Assignee: Moeller GmbH, Bonn (DE)

( * ) Notice: Subject to any disclaimer, the term of this patent is extended or adjusted under 35 U.S.C. 154(b) by 493 days.

(21) Appl. No.: 10/596,236

(22) PCT Filed: Nov. 19, 2004

(86) PCT No.: PCT/EP2004/053026

§ 371 (c)(1),
(2), (4) Date: Jan. 17, 2007

(87) PCT Pub. No.: WO2005/055264

PCT Pub. Date: Jun. 16, 2005

(65) Prior Publication Data

US 2007/0274061 A1 Nov. 29, 2007

(30) Foreign Application Priority Data

Dec. 5, 2003 (DE) ..... 203 18 855 U

(51) Int. Cl.
*H01H 85/175* (2006.01)

(52) U.S. Cl. ..... 361/833; 361/823; 361/837; 361/630; 361/628; 174/59

(58) Field of Classification Search ..... 361/823, 361/833, 837, 627–630; 174/59
See application file for complete search history.

(56) References Cited

U.S. PATENT DOCUMENTS

| | | | | |
|---|---|---|---|---|
| 3,290,474 | A | 12/1966 | Gelzheiser | |
| 4,425,018 | A * | 1/1984 | Stenz | 439/716 |
| 6,036,542 | A * | 3/2000 | Montague et al. | 439/595 |
| 6,491,544 | B1 * | 12/2002 | Lias et al. | 439/507 |
| 6,589,071 | B1 * | 7/2003 | Lias et al. | 439/511 |

OTHER PUBLICATIONS

Moeller: "Installation Instructions NZM7", 'Online! Jan. 10, 2003, Moeller, Bonn, XP002321317 URL:ftp://ftp.moeller.net/DOCUMENTATION/AWA_INSTRUCTIONS/13381202.pdf, pp. 1-4.

* cited by examiner

*Primary Examiner*—Dameon E Levi
(74) *Attorney, Agent, or Firm*—Darby & Darby

(57) ABSTRACT

A connection module arrangeable on a connection side of a main casing of a power switch comprises a plurality of connection spaces limited by a removable covering cap and by lateral separation walls. When the connection module is mounted, connection bars provided with a through hole and arranged in the main casing are projected into the connection spaces, which are provided with lateral guiding elements formed in the separation walls for frame terminals surrounding the connection bars and for guiding elements on bottom side for screw plates placed under the connection bars. A cylindrical reception area coaxially extends with respect to the associated through hole from each connection space bottom and is closed on a bottom side by a breakable wall part and receives a connection sleeve through the broken wall part in such a way that the connection sleeve is at least indirectly connected to the associated connection bar.

4 Claims, 5 Drawing Sheets

CONNECTION MODULE FOR A POWER SWITCH

CROSS REFERENCE TO PRIOR RELATED APPLICATIONS

This is the U.S. national phase under 35 U.S.C. §371 of International Patent Application No. PCT/EP2004/053026, filed Nov. 19, 2004, and claims benefit of German Patent Application No. 20318855.1, filed Dec. 5, 2003, the entire subject matter of which is incorporated by reference herein. The International Application was published in German on Jun. 16, 2005 as WO 2005/055264 A1.

FIELD OF ART

The present invention relates to a connection module for low-voltage circuit breakers.

BACKGROUND

The firm Moeller GmbH sells multipole circuit breakers of the type NZM7, which are provided with a connection module on both incoming and outgoing sides, said connection modules having terminal compartments which are isolated from each other and which can be equipped with additional features for different types of connection. Contact straps provided with a through-hole extend from the interior of the circuit breaker into the terminal compartments. To allow connection of round conductors, provision is made for box terminals which can be inserted into the terminal compartments from the front side, and which embrace the contact straps when the connection module is attached to the main housing of the circuit breaker. The box terminals are held by first guide elements extending perpendicular to the front side of the circuit breaker and by a front cover as well as the terminal compartment bottoms facing the bottom wall of the circuit breaker. To allow connection of flat conductors or cable lugs, provision is made for threaded plates which can be inserted into the terminal compartments in a direction toward the terminal side. The threaded plates are clampingly held by second guide elements which are formed on the terminal compartment bottoms and extend parallel to the bottom wall. First terminal screws extend through connection holes of the flat conductors or cable lugs, the through-holes of the contact straps, and tapped holes of the threaded plates, and into through-openings connecting the terminal compartment bottoms to the bottom wall. To allow connection of conductor bars of a busbar adapter to be connected to the circuit breaker on the bottom side, provision is made for terminal sleeves. The cylindrical terminal sleeves extend from the bottom wall into the through-openings, abut the contact straps at one end and, at the other end, they extend from the bottom wall to connection holes of the conductor bars. Second terminal screws extend through the through-holes of the contact straps and through the terminal sleeves, and into female threads of the conductor bars. A cover has access openings through which the clamping screws of the box terminals, or the first or second terminal screws can be operated using a screw tool. In order to provide the required clearance and creepage distances between the terminal compartments, three-pole circuit breakers are provided with six individual sealing plugs, and four-pole circuit breakers are provided with eight individual sealing plugs, said sealing plugs having to be inserted from the bottom wall into the through-openings when the connection is via box terminals or threaded plates.

SUMMARY

An object of the present invention is to provide the required clearance and creepage distances without any special component parts of the type of sealing plugs to be inserted at the bottom.

The present invention is directed to a connection module for a circuit breaker, the connection module being attachable to a main housing of the circuit breaker on a terminal side from which contact straps extend, and wherein the the connection module includes a breakaway wall portion that remains closed for certain connection types and can be removed for other connection types.

The connection module of the present invention can be used in a known manner to connect round cables using box terminals, to connect flat conductors or cable lugs using threaded plates, and to connect conductor bars of a busbar adapter using terminal sleeves. When using threaded plates, the screw ends of the first terminal screws are received by the cylindrical receptacles. In the case of the connection types using box terminals and threaded plates, the receptacles remain closed by breakaway wall portions. To implement the connection type that uses terminal sleeves, it is just necessary to remove the breakaway wall portions, for example, using a screwdriver, and to subsequently pass the terminal sleeves through the receptacles. In order to provide the required clearance and creepage distances between the terminal compartments, no further provisions in the form of additional sealing parts are required.

Depending on the specific design, the terminal sleeves may be passed through the receptacles from the bottom side or from the front side. On the one hand, it is advantageous for the terminal sleeve ends facing the front side to be expanded in the form of a flange in order to reduce the electrical contact resistance to the contact straps. On the other hand, it is advantageous if the terminal sleeve ends extending to the conductor bars are expanded in the form of a flange in order to provide stable positioning with respect to the bottom wall. If the receptacles are polygonal cylindrical in shape, it is possible to use serrated lock nuts in place of the threaded plates. Said serrated lock nuts are available as standard parts and are to be inserted into the receptacles before the connection module is attached to the main housing.

BRIEF DESCRIPTION OF THE DRAWINGS

Further details and advantages of the present invention will become apparent from the exemplary embodiment described below with reference to the Figures, in which.

DETAILED DESCRIPTION

Figure 1:
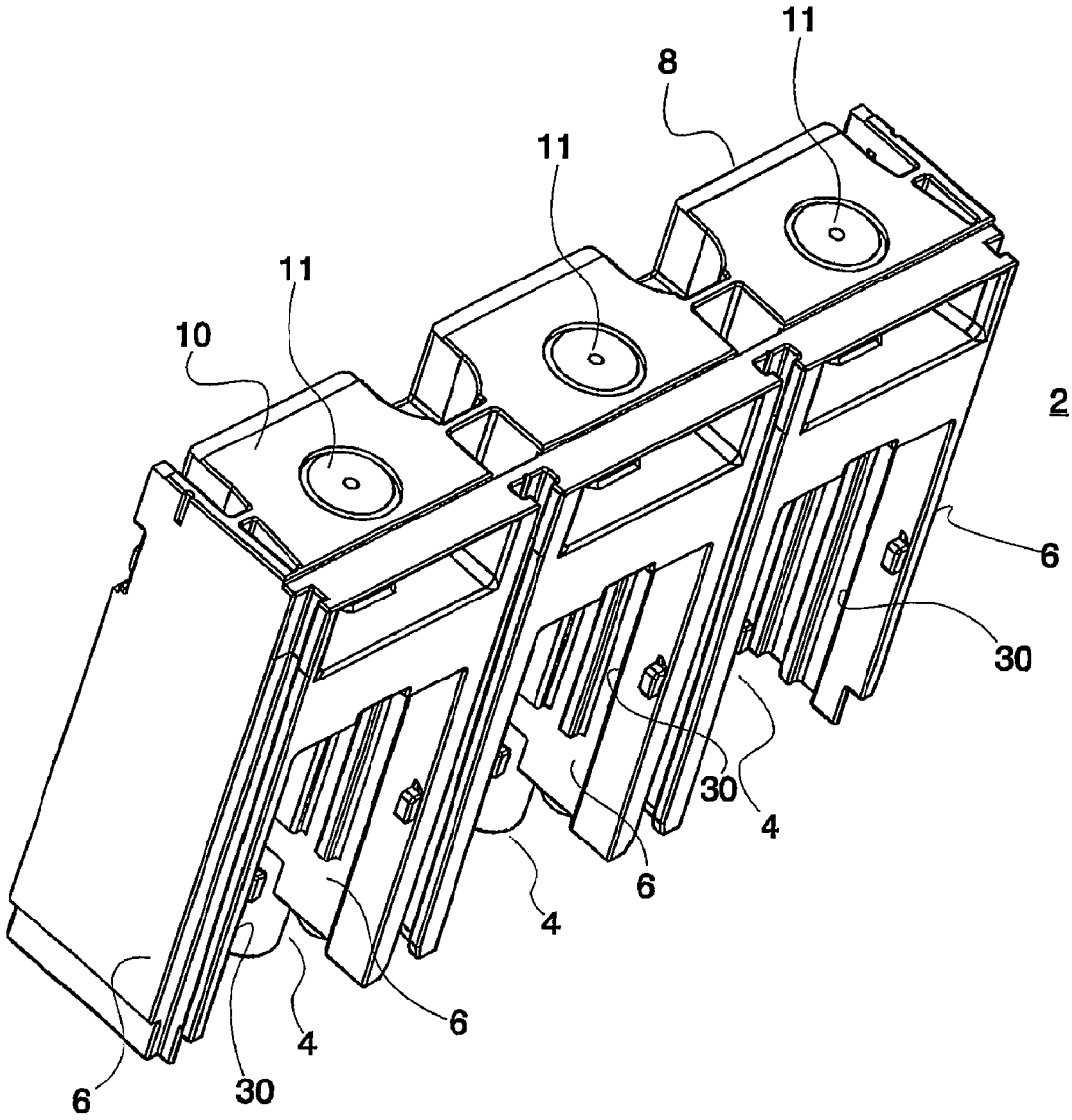
FIG. 1 is a perspective view of a connection module according to the present invention.

FIG. 1 is a bottom-side and terminal-side view of a three-pole connection module 2, said connection module being made of plastic and being substantially rectangular parallelepiped. Connection module 2 has formed therein three terminal compartments 4, which are laterally bounded by partitions 6. The connection module further has a rear wall 8 on the device side as well as a bottom wall 10. The bottom wall has a breakaway wall portion 11 within the imaginary extension of each terminal compartment 4. On each of the two terminal sides of a main housing 12 (only fragmentarily shown), connection module 2 is attached via tongue and groove joints 14, illustrated in FIGS. 2 through 4 for one terminal side only. A contact strap 16 extends from the interior of a main housing 12 into each terminal compartment 4. Contact straps 16 are folded at the ends and provided with a through-hole 18. In order for terminal compartments 4 to be bounded on the front side and partially on the terminal side, a cover 20 is placed on connection module 2 and fastened with screws.

Figure 2:
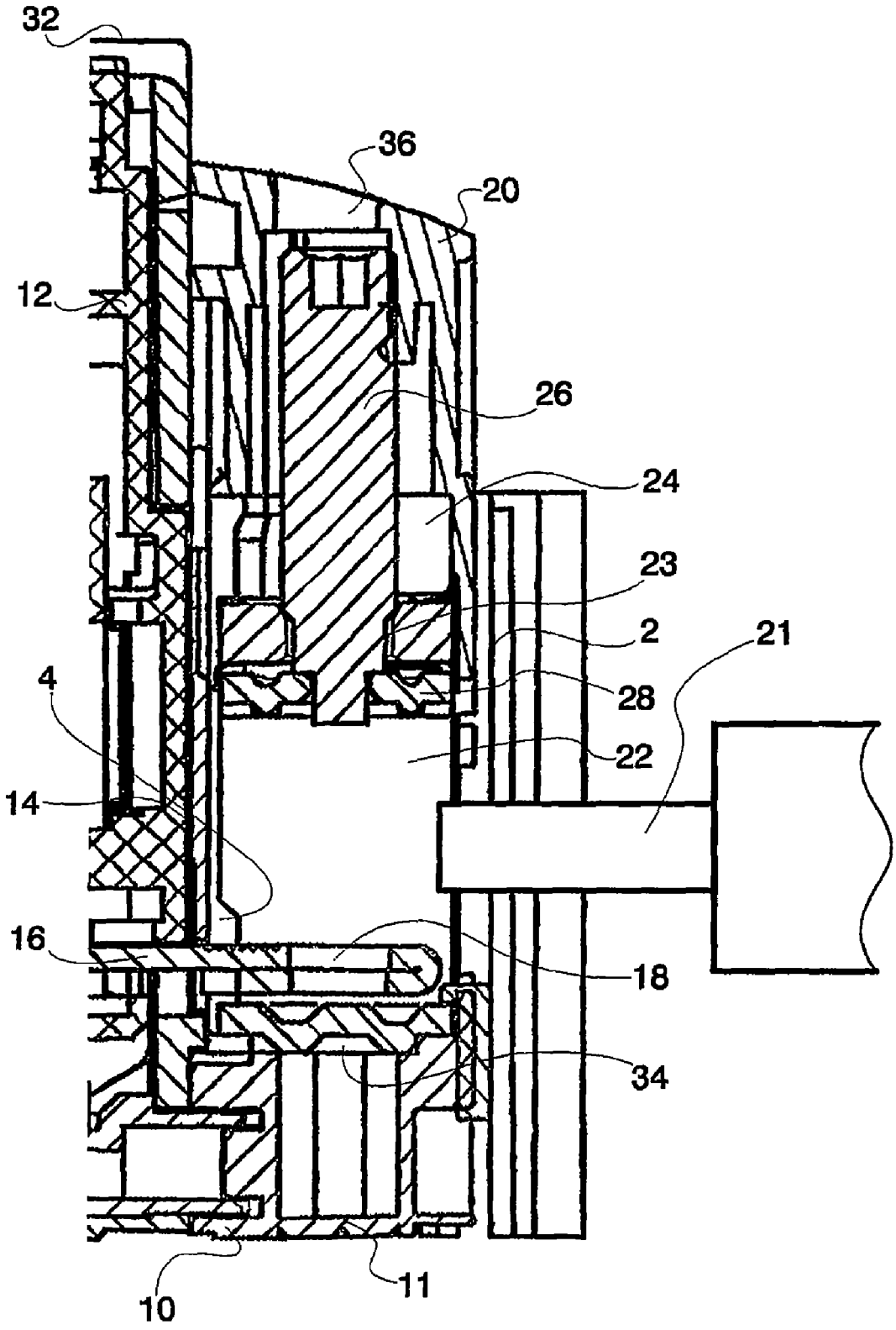
FIG. 2 shows the connection module for round conductors in a longitudinal sectional view.

In FIG. 2, connection module 2 is configured for connection of round conductors 21. For this purpose, box terminals 22 are inserted into terminal compartments 4 from the front side prior to placing cover 2 onto connection module 2 and prior to attaching connection module 2 to main housing 12. As is usual, each box terminal 22 is composed of a clamping box 24, a clamping screw 26 guided therein by a threaded guide 23, as well as a clamping plate 28 rotatably mounted on the end of said clamping screw. Box terminals 22 are held by strip-shaped lateral guide elements 30 (FIG. 1) extending in partitions 6 in a direction perpendicular to front side 32 of main housing 12, and by cover 20 and terminal compartment bottoms 34. After connection module 2 is clipped onto main housing 12, clamping boxes 24 embrace contact straps 16. The clamping screws can be operated on the front side through screw access openings 36 provided in cover 20. If, as shown, connection module 2 is equipped with box terminals 22, breakaway wall portions 11 are retained.

Figure 3:
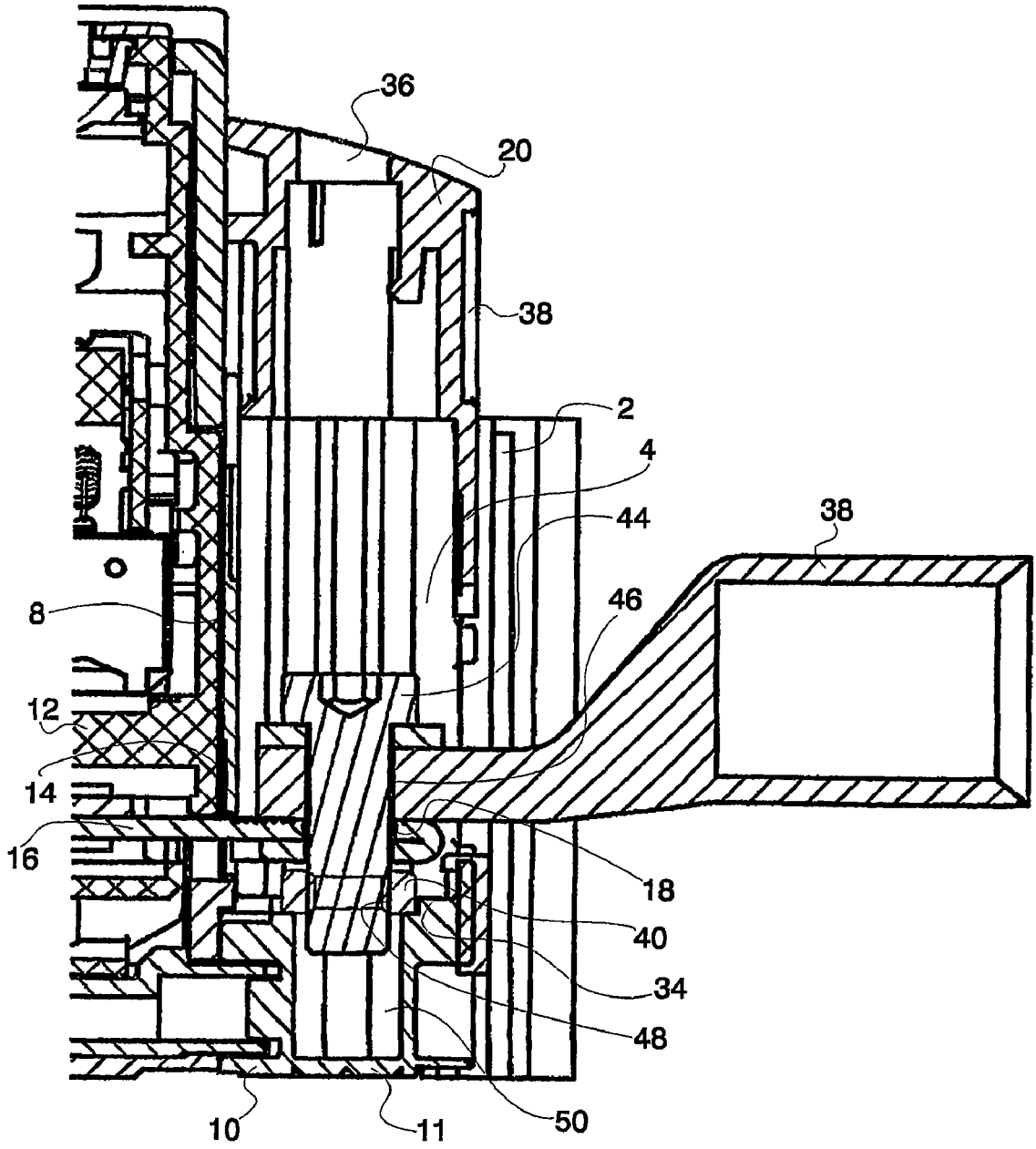
FIG. 3 shows the connection module for flat conductors and cable lugs in a longitudinal sectional view.
Figure 5:
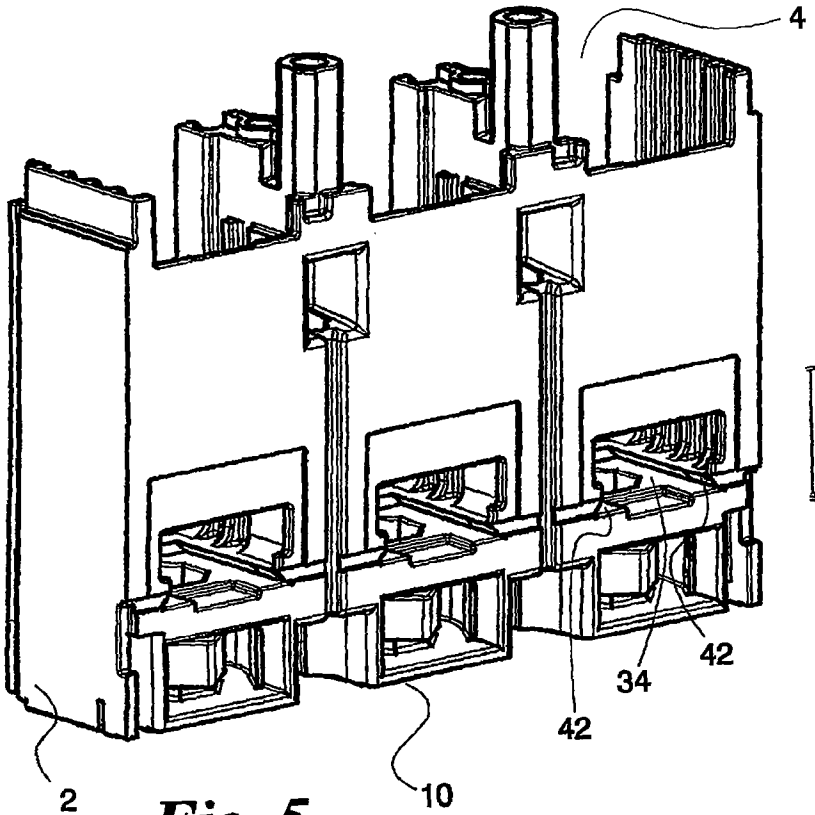
FIG. 5 shows the connection module in a different perspective view.

In FIG. 3, connection module 2 is configured for connection of flat conductors or cable lugs 38. For this purpose, provision is made for threaded plates 40, which can be inserted between contact straps 16 and terminal compartment bottoms 34 from rear wall 8 prior to attaching connection module 2 to main housing 12. Threaded plates 40 are clampingly held by dovetailed bottom-side guide elements 42 (FIG. 5) which are formed on terminal compartment bottoms 34 and extend parallel to bottom wall 10. First terminal screws 44 extend through connection holes 46 of flat conductors or cable lugs 38, through-holes 18 of contact straps 16, and tapped holes 48 of threaded plates 40, and into receptacles 50. The octagonal cylindrical receptacles 50 originate at terminal compartment bottoms 34, extend concentrically with respect to through-holes 18 of contact straps 16, and are closed at the bottom by breakaway wall portions 11. First terminal screws 44 can be operated on the front side through screw access openings 36 provided in cover 20.

Figure 4:
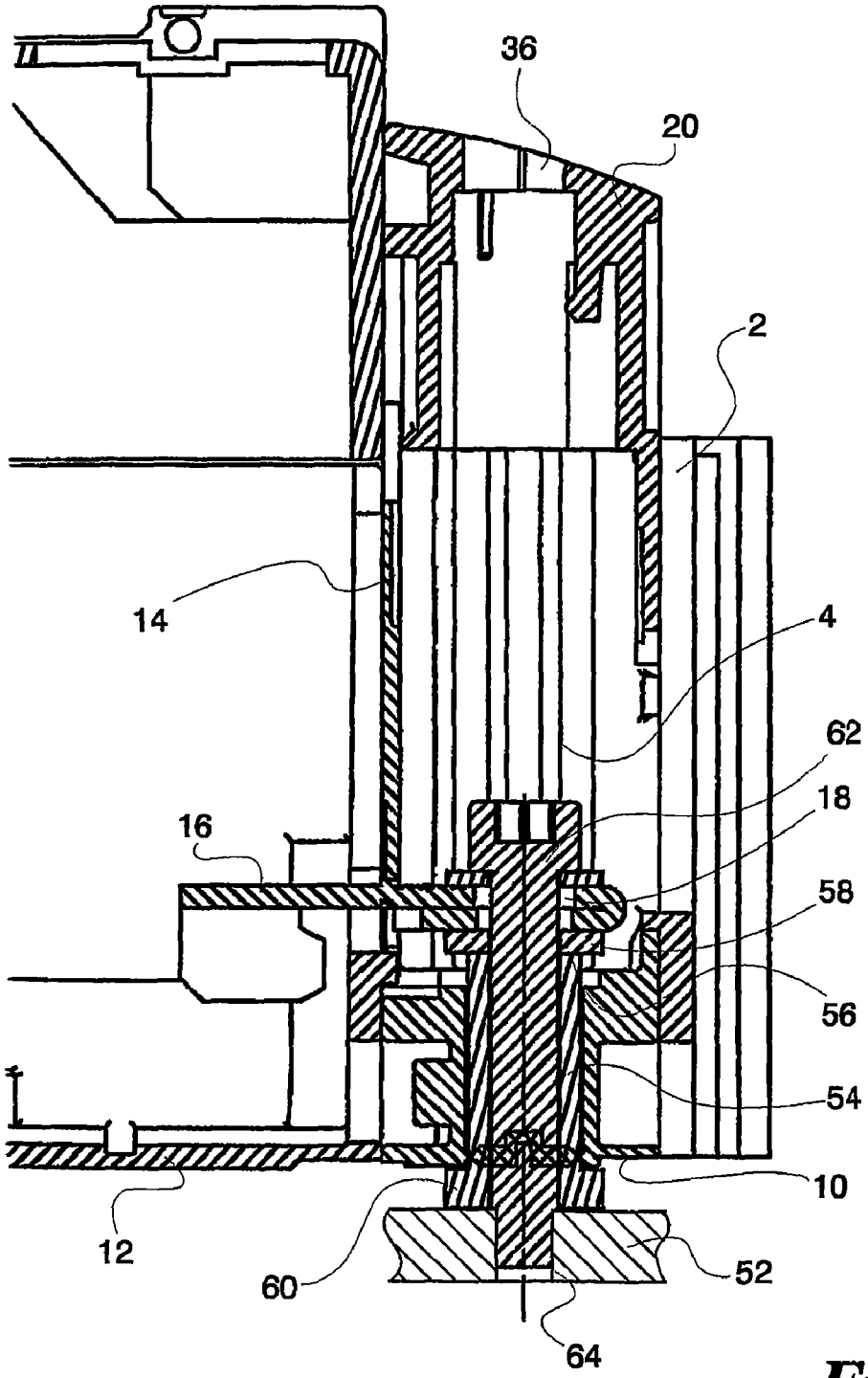
FIG. 4 is a longitudinal sectional view of the connection module for conductor bars of a busbar adapter.

In FIG. 4, connection module 2 is configured for connection of conductor bars 52 of a busbar adapter to be connected to the circuit breaker on the bottom side. For this purpose, provision is made for cylindrical terminal sleeves 54. After breakaway wall portions 11 (FIG. 1) are broken away, cylindrical terminal sleeves 54 are passed through receptacles 50 from bottom side 10. Front-side ends 56 of terminal sleeves 54 are each in electrical contact with contact straps 16 via an intermediate plate 58. The bottom-side end of each terminal sleeve 54 is expanded to form a flange 60 with which it abuts flush against bottom wall 10 on the outside. Second terminal screws 62 extend through through-holes 18 of contact straps 16, through intermediate plates 58 and terminal sleeves 54, and into female threads 64 of conductor bars 52. Second terminal screws 62 can also be operated on the front side through screw access openings 36. Alternatively to the terminal sleeves 54 described above, it is also possible for the terminal sleeves to be configured to have an additional flange, or only one flange, at the front-side end, said flange facing toward contact strap 16.

Figure 6:
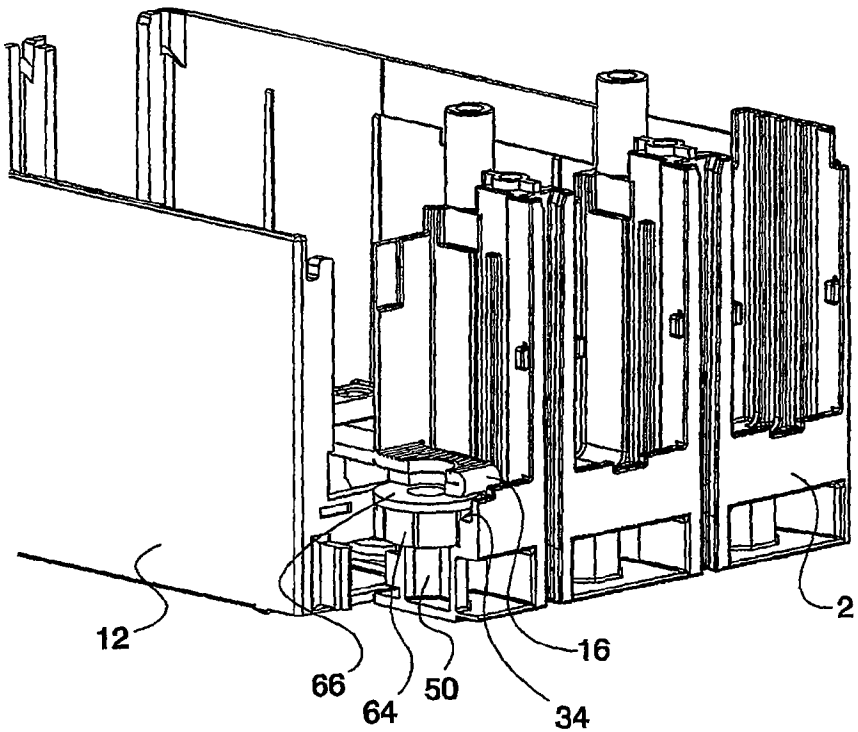
FIG. 6 shows an alternative embodiment of the connection module.

One alternative for the threaded plates 40 shown in FIG. 3 is to use serrated lock nuts 64, illustrated in FIG. 6. Serrated lock nuts 64 are inserted in the portions of receptacles 50 facing away from bottom wall 10 before connection module 2 is clipped onto main housing 12. After connection module 2 is clipped onto main housing 12, serrated lock nuts 64 are located in terminal compartment bottoms 34 with their locking flanges 66 below contact straps 16 and in a concentric relationship with respect to through-holes 18.

What is claimed is:

1. A connection module for a circuit breaker, the connection module being attachable to a main housing of the circuit breaker on a terminal side from which contact straps extend, the connection module comprising:

a plurality of terminal compartments, each bounded by a first side partition, a second side partition, a rear wall, and a terminal compartment bottom, wherein:

each rear wall includes an opening for one of the contact straps to extend into a corresponding one of the plurality of terminal compartments when the connection module is attached to the main housing;

the plurality of terminal compartments are provided with lateral guide elements for box terminals to contact the contact straps, said lateral guide elements being formed in each of the first partition and the second partition; and the plurality of terminal compartments are provided with bottom-side guide elements for threaded plates to be inserted below the contact straps;

a removable cover, removably coupled to a front of the connection module and bounding a front of each of the plurality of terminal compartments, wherein the removable cover is provided with a fastener access opening at each of the plurality of terminal compartments; and a plurality of receptacles, each originating at a corresponding terminal compartment bottom and extending away from a corresponding terminal compartment, each receptacle configured to extend coaxially with a through-hole of a corresponding contact strap, and each receptacle being closed at an opposite end that includes a breakaway wall portion for breaking away to receive a terminal sleeve for coupling to the corresponding contact strap.

2. The connection module as recited in claim 1, further comprising the terminal sleeve with a flange at an end thereof.

3. The connection module as recited in claim 1, further comprising a fastener accessible through a corresponding fastener access opening to couple one of a corresponding box terminal, threaded plate, or terminal sleeve to the contact strap.

4. The connection module as recited in claim 1, wherein each of the plurality of receptacles is cylindrical.

* * * * *